United States Patent [19]

Mizell

[11] Patent Number: 4,753,836

[45] Date of Patent: Jun. 28, 1988

[54] SURFBOARD CONSTRUCTION

[76] Inventor: James A. Mizell, 419 Main Street #86, Huntington Beach, Calif. 92648

[21] Appl. No.: 26,046

[22] Filed: May 22, 1987

[51] Int. Cl.[4] ..... B32B 1/04; B32B 3/02; A63C 15/05

[52] U.S. Cl. ..... 428/71; 428/76; 428/316.6; 441/74

[58] Field of Search ..... 428/71, 76, 316.6; 441/68, 74; 280/610

[56] References Cited

U.S. PATENT DOCUMENTS

| | | | |
|---|---|---|---|
| 3,918,731 | 11/1975 | Legrand | 280/610 |
| 4,383,955 | 5/1983 | Rubio et al. | 441/74 |
| 4,476,183 | 10/1984 | Holtrop et al. | 428/316.6 |
| 4,551,290 | 11/1985 | Mizell | 441/74 |
| 4,602,396 | 7/1986 | Fraige | 428/71 |

FOREIGN PATENT DOCUMENTS

| | | | |
|---|---|---|---|
| 46204 | 2/1982 | European Pat. Off. | 428/71 |

*Primary Examiner*—William J. Van Balen
*Attorney, Agent, or Firm*—Edgar W. Averill, Jr.

[57] ABSTRACT

A lightweigh resin/glass fiber covered plastic article such as a surfboard. A portion of the upper surface of the article has the ability to withstand exterior surface pressure applied on a small area without damage to the surface thereof. The article has a rigid foam core to which a resilient foam cushion is adhered over which a thin rigid foam sheet is applied and the entire article is coated with a resin and glass fiber layer. The method of making the article is also disclosed herein.

8 Claims, 2 Drawing Sheets

FIG. 1.
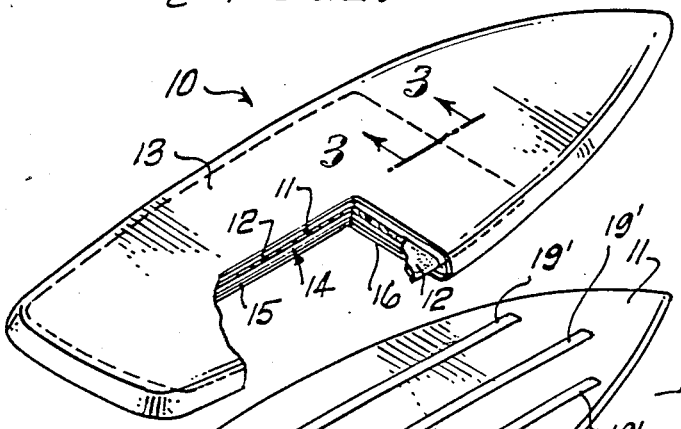
FIG. 2.
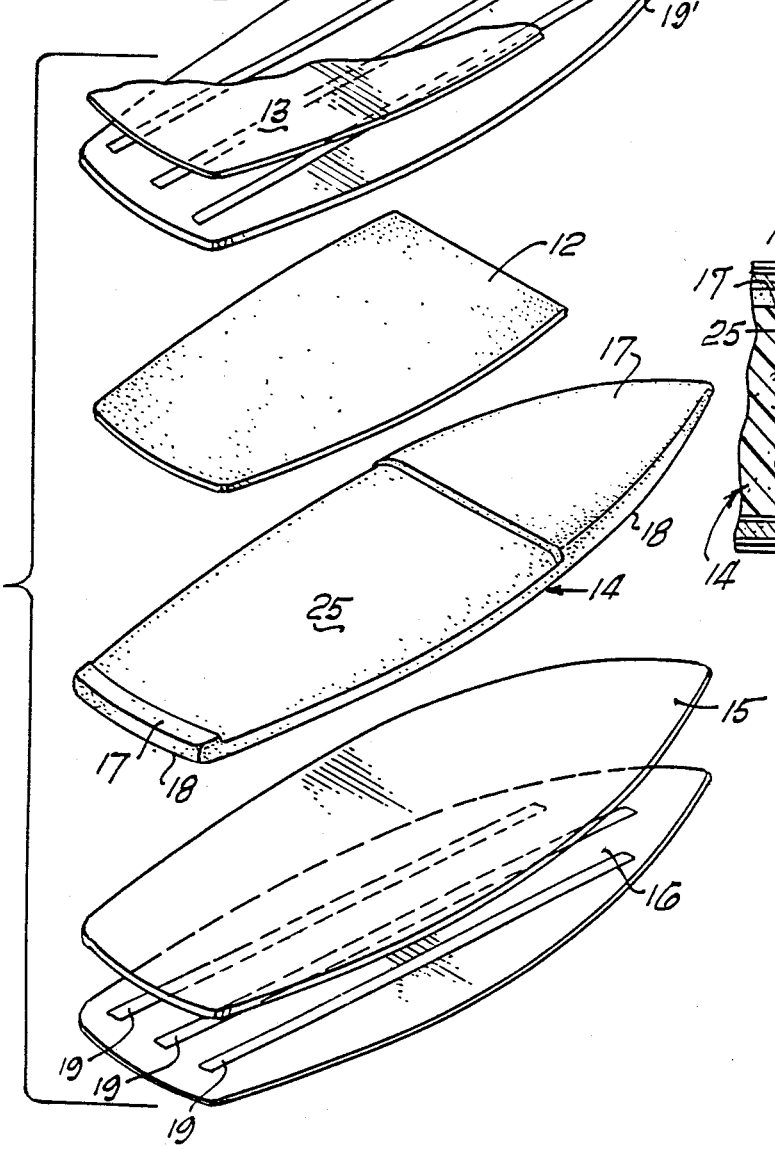
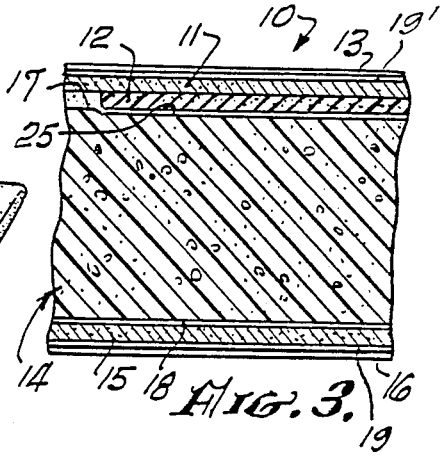
FIG. 3.

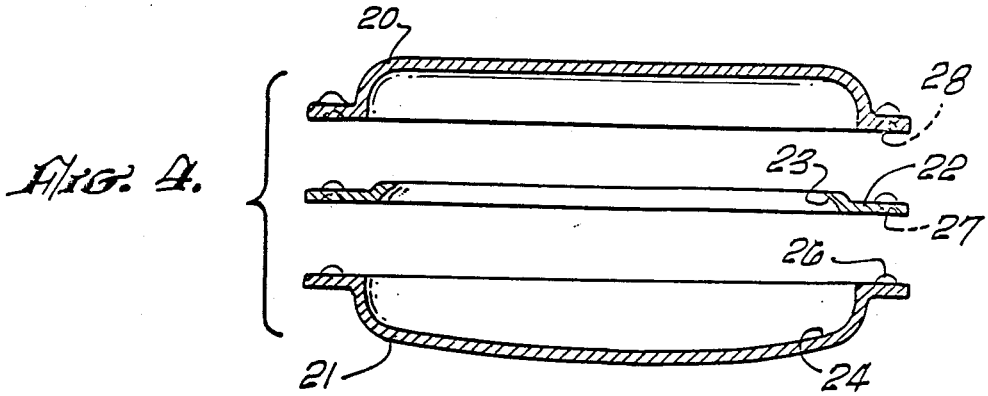
FIG. 4.
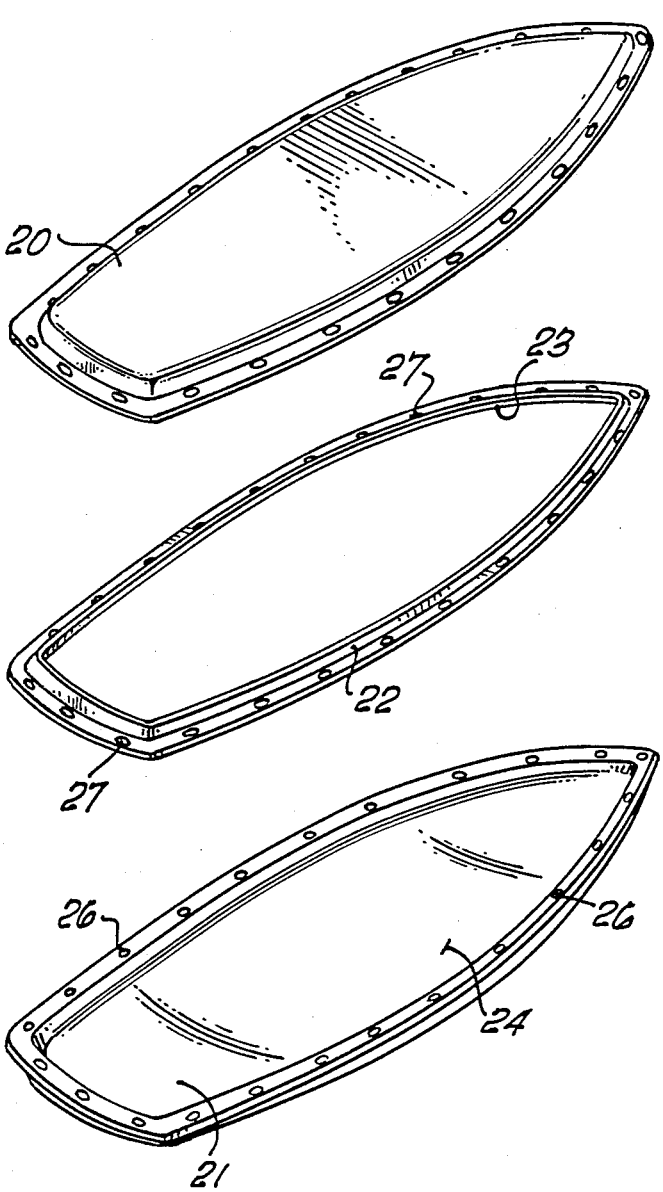
FIG. 5.
FIG. 6.
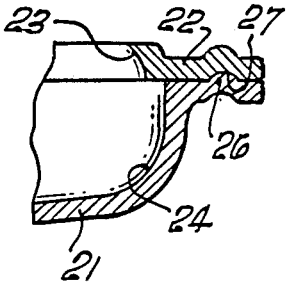

SURFBOARD CONSTRUCTION

BACKGROUND OF THE INVENTION

The field of the invention is plastic fabrication and the invention relates more particularly to lightweight resin/glass fiber covered plastic articles such as surfboards and the process for making the same.

Surfboards are typically made by shaping a rigid foam block which is cut and sanded to the desired shape and coated with various layers ending with a resin and glass fabric layer which provides the structural support for the user. Surfboards are subjected to a relatively large unit surface pressure such as by the user's knees which, if the resin and glass fabric layer is not sufficiently strong, will often crack, permitting water to enter the board. The typical solution to this problem is to provide a thicker resin and glass fiber layer, but this approach increases the weight of the surfboard which is a disadvantage. An "outside in" process is disclosed in applicant's U.S. Pat. No. 4,383,955, but such board also required a relatively thick resin and glass fabric layer to prevent any cracking or crazing from external forces.

SUMMARY OF THE INVENTION

It is an object of the present invention to provide a construction of surfboard, or other lightweight plastic covered article, which has exceptional ability to withstand external pressure without cracking or crazing in the process of making such article.

The present invention is for a lightweight resin/glass fiber covered plastic article such as a surfboard having a portion of its upper surface having the ability to withstand exterior surface pressure applied on a small area without damaging the surface thereof. The article comprises a generally flat rigid foam core, having a top and a bottom surface. A layer of an adhesive foam surrounds the foam core. A resilient foam cushion pad is adhered to that portion of the core which is required to have excellent resistance to pressure. A sheet of rigid foam completely covers the top and bottom surface of the rigid foam core and covers said resilient foam cushion pad. A layer of resin and glass fabric completely covers the outer surface of the entire article. Preferably, a majority of the thickness of the article comprises the rigid foam core and both the resilient foam cushion pad and each of the sheets of rigid foam are less than about one-tenth of the thickness of the article. The process involves coating the inner surface of two mold halves with the resin and glass fabric layer and adhering the rigid foam sheets to the inner surface of each coated mold half. Next, the resilient foam cushion pad is adhered to the inner surface of at least a portion of at least one of the rigid foam sheets and a shaped, rigid foam core is placed on one of the mold halves, and a slow reacting foam is placed about the rigid foam core. The mold halves are then assembled and the slow reacting foam is permitted to rise to fill any void spaces within the mold. Two or more reinforcing strips may be used between the resin and glass fabric bottom and the inner foam core such as epoxy/glass strips.

BRIEF DESCRIPTION OF THE DRAWINGS

FIG. 1 is a perspective view partially cut away of the surfboard of the present invention.

FIG. 2 is an exploded perspective view of the layers of the surfboard of FIG. 1.

FIG. 3 is an enlarged cross-sectional view taken along line 3—3 of FIG. 1.

FIG. 4 is an exploded cross-sectional view of the mold halves and mold ring of the process of the present invention.

FIG. 5 is an exploded perspective view of the mold parts of FIG. 4.

FIG. 6 shows a removable mold ring assembled with a mold half.

DESCRIPTION OF THE PREFERRED EMBODIMENTS

The surfboard of the present invention is shown in perspective view in FIG. 1 and indicated by reference character 10. While the term "surfboard" is widely used in the present application, the article could just as well be used as a windsurfer or other lightweight structural object. The surfboard of the present invention has a combination of exceptionally light weight together with the ability to withstand the pressure of a surfer's knee or heel without cracking or crazing. For instance, a surfboard made according to the present invention having a height or length of six feet, one inch weighs only seven pounds. At the same time, the surfboard in tests has not shown any cracking or crazing in areas of knee and heel pressure.

This ability to resist cracking or crazing is believed to be a result of the combination of a thin, relatively rigid foam layer indicated by reference character 11, in FIG. 3, under which a resilient foam cushion pad 12 is adhered. Layers 11 and 12 are directly under a thin skin 13 of gel coat, decorative fabric, glass fibers and resin. The total thickness of this thin skin 13 is typically less than one sixty-fourth of an inch.

A thick layer of foam core 14 is made from a low-density polymeric foam such as polystyrene foam having a density of one pound per cubic foot. The bottom surface of surfboard 10 does not have to withstand the knee and heel pressure of the top surface and, thus, has only a rigid foam layer 15 between the core 14 and the outer thin skin 16 of gel coat, fabric, glass fibers and resin.

The various layers of surfboard 10 are shown in exploded perspective view in FIG. 2 where it can be seen that the resilient foam cushon pad 12 covers only a portion of the upper surface of core 14. It is desirable to limit the area of coverage of the foam cushion pad 12 since it has a higher density than the foam core and, thus, adds slightly to the weight of the surfboard. Since the user's heels and knees cover only the area indicated in FIG. 2 by the foam cushion pad, this is the only area where the pad need be present. It can also be seen that the rigid foam layers 11 and 15 are cut to the shape of the board and completely cover the upper surface 17 and lower surface 18 of foam core 14. The thin skin 13, although described herein as including a decorative fabric layer, need not have such layer since this is, of course, only for surface ornamentation. However, this layer can provide a dramatic and attractive appearance to the surfboard and does not detract from the strength thereof. It has been found that printed polyester fabric can be added right under the gel coat surface sprayed on the mold halves described below which provides a colorful surface for the board.

Other board weights include a weight of eight pounds for a board having a length of six and one-half feet, eleven pounds for a board having a length of eight feet, and nine pounds for a board having a length of seven feet.

The process for making the surfboard of the present invention is accomplished by the use of the mold shown in FIGS. 4 and 5 of the drawings. The mold half 20 is used for the surfboard bottom and the mold half 21 is used for the surfboard top. A mold ring 22 is used in the molding process and removed before halves 20 and 21 are assembled. The first step of the process is to place mold ring 22 over mold half 21. As shown in FIG. 6, the coatable inner surface 23 of mold ring 22 extends further inwardly than the inner surface 24 of mold half 21. After the inner surfaces 23 and 24 have been coated and the resin hardened, mold ring 22 is removed and coated mold half 20 is inserted so that the inner layer of resin on mold half 20 contacts the surface of the resin which formerly contacted inner surface 25. This permits a smooth intersection between the upper and lower halves of the board, thereby eliminating any point of weakness or unsightly seam.

Mold ring 22 is aligned on mold half 21 by the mating of a plurality of protrusions 26 with a plurality of indentations 27 on mold ring 22. After assembly of mold ring 22 and mold half 21, the inner surface is coated with a gel coat and, preferably, with a decorative layer of dacron fabric. Next, a layer of glass fiber cloth is laid up over the entire mold surface and coatable surface 25 and the glass fabric is trimmed and allowed to harden. Also, mold half 20 with its coatable surface facing up is also sprayed with a gel coat and coated with a glass cloth, trimmed and allowed to harden.

Next, thin sheets of toluene diisocynate (TDI) foam having a thickness of about three-eighths of an inch and a density of about four pounds per cubic foot is cut to fit over essentially the entire inner surface of mold halves 20 and 21. It is important that this sheet be securely and completely adhered to the resin and glass layer already cured to the mold halves. A particularly effective way of accomplishing this is to provide a plurality of holes through the thin TDI sheet and to apply a layer of resin between the TDI sheet and glass and resin layer and to secure the TDI sheet to the glass layer by the use of a vacuum bag drawing a vacuum within the bag of at least about twenty-five pounds. The resin passes through the holes in the TDI sheet and any air trapped between the TDI sheet and the glass/resin layer is permitted to escape through the holes and, thus, the sheet is very securely adhered to the resin/glass layer. Next, the vacuum bag for mold half 21 is opened and a cut sheet 12 of resilient foam cushion is coated on the surface adjacent to the TDI sheet and placed as shown in FIG. 2 of the drawings. The resilient foam cushion has a density of about twelve pounds per cubic inches (12 lbs./in. 3). It was fabricated from a polymer which has excellent water resistance as well as resilience. The vacuum is once again drawn on the vacuum bag and the resilient foam layer is securely adhered to the inner surface of the TDI sheet.

Alternatively, the TDI foam layers may be sprayed and foamed in place, in which case, no vacuum bag step is necessary. In addition, it has been found beneficial to add two or more resin/fiber reinforcing strips 19 between the bottom 16 of the resin and the inner foam construction. The resin is preferable an epoxy resin and the fibers may be glass fibers, carbon fibers or polymeric fibers of the type sold under the trademark, "KEVLAR." Also, such strips can be added between layer 13 and the inner foam to add additional bonding resistance. The strips are preferably about ¾ of an inch wide and 0.040 inches thick. Their length should be along a majority of the board's length.

Next, the mold ring 22 is removed in preparation for the final joining of mold halves 20 and 21. The sheet of foam core 14 is then shaped and the mold surfaces are coated with a slow reacting foam, after which the foam core 14 is placed on the inner surface of mold half 21 and mold half 20 is placed over mold half 21 and clamped in place. The foam core is made from styrofoam beads and has a density of about one pound per cubic foot. The protrusions 26 on mold half 21 mate with indentations 28 on mold half 20. Before this mating step, the outer surface, which had formerly been in contact with coatable inner surface 23, is coated with a thin layer of resin and glass fabric to provide an adhesive between the top and bottom halves of the board. After clamping, the slow reacting foam expands to completely fill any voids within the mold halves. The slow reacting foam further acts as a barrier between resin which has passed through layers 11 and 15 and the inner foam core 14. Polystyrene foam is dissolved by polyester resin and, thus, this foam layer between the two acts as a barrier to prevent any dissolving as well as an adhesive.

It is also beneficial that a cutout portion, indicated by reference character 25 in FIG. 2, be formed in foam core 14 to facilitate the placement of resilient foam cushion pad 12 in place.

It has been found that the board of the present invention is typically about two pounds lighter than a typical high-quality surfboard made by a conventional process. Even if the surface does somehow become punctured, the foam core being fabricated from a closed cell polystyrene foam will not permit any water absorption and, thus, the board will not tend to gain weight as do most prior art surfboards.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A lightweight resin/glass fiber covered plastic article such as a surfboard having a portion of its upper surface having the ability to withstand exterior surface pressure applied on a small area without damaging the surface thereof, said article comprising:

a generally flat, rigid foam core having a top and a bottom surface;

a layer of an adhesive foam surrounding said foam core;

a resilient foam cushion pad adjacent that portion of the core which is to require resistance to pressure;

a sheet of rigid foam completely covering the top and bottom surface of said rigid foam core and covering said resilient foam cushion pad; and a layer of resin and glass fabric completely surrounding the entire article.

2. The lightweight resin-glass fiber covered plastic article of claim 1 wherein rigid foam core is greater than one-half of the overall thickness of the article.

3. The lightweight resin/glass fiber covered plastic article of claim 2 wherein the resilient foam cushion pad is less than about one-tenth of the thickness of the article.

4. The lightweight resin/glass fiber covered plastic article of claim 2 wherein the sheet of rigid foam is less than about one-tenth of the thickness of the article.

5. The lightweight resin/glass fiber covered plastic article of claim 1 wherein the rigid foam core has a density of about one pound per cubic foot and the sheet of rigid foam has a density of about four pounds per cubic foot.

6. The lightweight resin/glass fiber covered plastic article of claim 1 wherein the article further includes a decorative layer of fabric on the exterior of the glass fiber layer and a gel coat layer on the outer surface of said decorative layer of fabric.

7. The lightweight resin/glass fiber covered plastic article of claim 1 wherein said resilient foam cushion pad covers most of the upper surface of the rigid foam core.

8. A lightweight resin/glass fiber covered surfboard having the ability to withstand exterior surface pressure applied on a small area without damaging the surface thereof, said surfboard comprising:

a generally flat, rigid foam core having a top and a bottom surface;

a layer of an adhesive foam surrounding said foam core;

a resilient foam cushion pad adjacent that portion of the top surface of said foam core;

a sheet of rigid foam completely covering the top and bottom surface of said rigid foam core and covering said resilient foam cushion pad; and a layer of resin and glass fabric completely surrounding the entire article.

* * * * *